US008776279B2

(12) United States Patent
Smith

(10) Patent No.: US 8,776,279 B2
(45) Date of Patent: Jul. 15, 2014

(54) TOILET TRAINING SYSTEM

(76) Inventor: Zoe Smith, Muizenburg (ZA)

( * ) Notice: Subject to any disclaimer, the term of this patent is extended or adjusted under 35 U.S.C. 154(b) by 0 days.

(21) Appl. No.: 13/640,144

(22) PCT Filed: Apr. 4, 2011

(86) PCT No.: PCT/IB2011/051431

§ 371 (c)(1),
(2), (4) Date: Dec. 26, 2012

(87) PCT Pub. No.: WO2011/125014

PCT Pub. Date: Oct. 13, 2011

(65) Prior Publication Data

US 2013/0097771 A1 Apr. 25, 2013

(30) Foreign Application Priority Data

Apr. 9, 2010 (ZA) ..... 2010/02501

(51) Int. Cl.
*A47K 13/00* (2006.01)

(52) U.S. Cl.
USPC ..... 4/237

(58) Field of Classification Search
CPC ..... A47K 11/00; A47K 13/00
USPC ..... 4/237–241
See application file for complete search history.

(56) References Cited

U.S. PATENT DOCUMENTS 4,807,308 A * 2/1989 Person et al. ..... 4/483
5,008,964 A * 4/1991 Dean et al. ..... 4/661
5,778,460 A * 7/1998 Doell et al. ..... 4/239
5,779,306 A * 7/1998 Ohlsson ..... 297/256.16
5,787,518 A * 8/1998 Mendelovich et al. ..... 4/449
5,903,932 A 5/1999 Whitesel
5,978,976 A * 11/1999 Chai ..... 4/483

(Continued)

FOREIGN PATENT DOCUMENTS

EP 2 000 068 A1 12/2008
WO WO 2010/016012 A1 2/2010
WO WO 2010016012 A1 * 2/2010 ..... A47K 11/06

OTHER PUBLICATIONS

International Search Report from PCT/IB2011/051431 dated Jul. 6, 2011 (date of completion of search) and Jul. 15, 2011 (date of mailing of report).

*Primary Examiner* — Lori Baker
(74) *Attorney, Agent, or Firm* — Clark & Elbing LLP

(57) ABSTRACT

A toilet training system comprises a seat (10) and a complemental base (12). The seat has a central seat member (34) with a curved surface defining a cavity shaped to accommodate a child, with an aperture (36) in its lower surface. The base comprises a cylindrical outer side wall (42) and a partition member extending transversely relative to the side wall to define a receptacle. The partition member has a central portion (50) with a surface which is inclined or curved complementally to the curved surface of the seat member. The seat can be mounted on the base in first and second configurations of the system. In the first configuration, the central portion of the partition member is located relatively close to the seat member, preferably touching it. This corresponds to a training or familiarising mode of use of the system. In the second configuration the partition member is spaced relatively further apart from the seat member, in which mode the system can be used as a potty. In a third mode of use, the seat can be mounted directly on the rim of a toilet.

15 Claims, 4 Drawing Sheets

(56) References Cited

U.S. PATENT DOCUMENTS

| | | | | |
|---|---|---|---|---|
| 8,079,097 | B2 * | 12/2011 | Deutsch | 4/483 |
| 2005/0188455 | A1 * | 9/2005 | Sharp | 4/484 |
| 2008/0083061 | A1 * | 4/2008 | Dubiel | 4/484 |
| 2008/0086804 | A1 * | 4/2008 | Goh Aow | 4/300 |
| 2008/0178379 | A1 * | 7/2008 | Davis | 4/483 |
| 2008/0263756 | A1 * | 10/2008 | Marsden | 4/239 |
| 2010/0043132 | A1 * | 2/2010 | Viglietta | 4/483 |
| 2010/0138984 | A1 * | 6/2010 | Buitendach | 4/239 |
| 2011/0030134 | A1 * | 2/2011 | Dubiel | 4/483 |
| 2011/0131718 | A1 * | 6/2011 | Smith | 4/483 |
| 2011/0214228 | A1 * | 9/2011 | Rosser | 4/483 |
| 2012/0084908 | A1 * | 4/2012 | Dunn et al. | 4/483 |
| 2012/0084909 | A1 * | 4/2012 | Dunn et al. | 4/483 |

* cited by examiner

TOILET TRAINING SYSTEM

CROSS-REFERENCE TO RELATED APPLICATIONS

This application is a U.S. national stage filing under 35 U.S.C. §371 of international application PCT/IB2011/051431, filed Apr. 4, 2011, which claims priority from South African Patent Application No. 2010/02501, filed Apr. 9, 2010.

BACKGROUND OF THE INVENTION

THIS invention relates to a toilet training system.

Toilet training of small children is generally undertaken when they are between 18 and 24 months old, and it is not uncommon for a child still to be wearing diapers up to the age of three. The adverse environmental impact as a result of "nappy mountains" is well known. Using fewer nappies not only helps to save the environment but also reduces the cost of nappies to the parent or caregiver.

Conventionally, various toilet training aids are used. The most basic of these is a chamber pot or "potty" which the child is taught to use as a step towards the use of a conventional flushing toilet. The child relieves him/herself in the pot and the parent or other caregiver has to empty the contents of the pot into the toilet bowl. The transition from the potty to the adult toilet is a big step.

Other devices for assisting in toilet training are known. For example, a step-up stool is known which enables a child to reach a toilet seat. Although this aid helps the child to climb up to the toilet seat, the aid is mainly suited for use by older toddlers and creates a risk of falling.

Other toilet trainers simply make seats having smaller apertures. However, these are often undesirable.

Generally, existing toilet training devices are not suitable for very young children (especially children under the age of 18 months) and require substantial intervention and supervision by an adult for effective use.

The above issues are addressed by the invention described in International patent application WO 2010/016012, which discloses a toilet training device or system which comprises a seat and an associated base defining a receptacle. The seat has a curved seat member with an aperture in it and can be mounted on the base or directly on the rim of a toilet. The base has a partition member which divides the base into two receptacles of different depth, allowing the seat to be used with the base in first and second configurations, and on a toilet in a third configuration of the system.

It is an object of the present invention to provide an alternative base for a toilet training system of this kind.

SUMMARY OF THE INVENTION

According to the invention there is provided a toilet training system comprising a seat and a complemental base, wherein the seat has a central seat member with a curved surface defining a cavity shaped to accommodate a child, the seat member having an aperture therein, the base comprising a cylindrical outer side wall and a partition member extending transversely relative to the side wall to define at least a first receptacle, the partition member having a central portion with a surface which is inclined or curved complementally to the curved surface of the seat member.

The seat may be mountable on the base in first and second configurations of the system, the central portion of the partition member being located relatively closely to the seat member in the first configuration, and being spaced relatively further apart from the seat member in the second configuration.

Preferably, in the first configuration the central portion of the partition member is spaced less than 5 cm from the underside of the seat member, more preferably less than 2 cm and still more preferably less than 1 cm.

Ideally, in the first configuration the central portion of the partition member should abut the underside of the seat member.

Further according to the invention there is provided a base for use with a seat of a toilet training system, wherein the seat has a central seat member with a curved surface defining a cavity shaped to accommodate a child, the seat member having an aperture therein, the base comprising a cylindrical outer side wall and a partition member extending transversely relative to the side wall to define at least a first receptacle, the partition member having a central portion with a surface which is inclined or curved complementally to the curved surface of the seat member.

The partition member may be cup shaped, with a central portion which extends generally transversely to the outer side wall, and an upstanding inner side wall disposed within the outer side wall and extending substantially parallel or at a shallow angle relative to the outer side wall.

The inner side wall is preferably cylindrical, and defines a receptacle having a circular or oval shape in section within the inner side wall.

The central portion of the partition member may be curved, with a curvature complemental to a curvature of the curved surface of the central seat member of the seat.

Preferably, the height of the inner side wall is selected such that when the base is in a first orientation thereof relative to the seat, the curved central portion of the partition member is spaced a first predetermined distance from the curved surface of the central seat member of the seat.

The first predetermined distance may be in the range 0 to 5 cm, preferably 0 to 2 cm.

Preferably, the first predetermined distance is less than 1 cm, in the region of about 1 mm or even less.

Essentially, when the base is in the first orientation thereof, the curved central portion of the partition member abuts or nearly abuts the curved under-surface of the central seat member of the seat.

Conversely, when the base is in a second orientation thereof relative to the seat, the curved central portion of the partition member is preferably spaced a second predetermined distance from the curved surface of the central seat member of the seat.

The second predetermined distance may be in the range 2 cm to 10 cm, preferably 4 cm to 7 cm, and most preferably about 5.5 cm.

The second predetermined distance is preferably measured vertically from the centre of the curved central portion of the partition member to a lowermost inner edge of the aperture in the seat member.

The system may include a cover or lid shaped to fit over an end of the base, the lid having a flat central surface and a peripheral formation for retaining the lid on the base.

DESCRIPTION OF AN EMBODIMENT

The present invention relates to a base unit which can be used together with a seat as described in international patent application WO 2010/016012 to provide a versatile toilet training device or system.

In the abovementioned international application, the contents of which are incorporated herein by reference, a seat 10 and a base unit 12 (referred to below simply as a base) are provided which can be used together, in first and second configurations of the toilet training system, or the seat can be used separately, mounted on the rim of a conventional toilet. The present invention seeks to provide an improved base for use with a substantially similar or identical seat.

Figure 1:
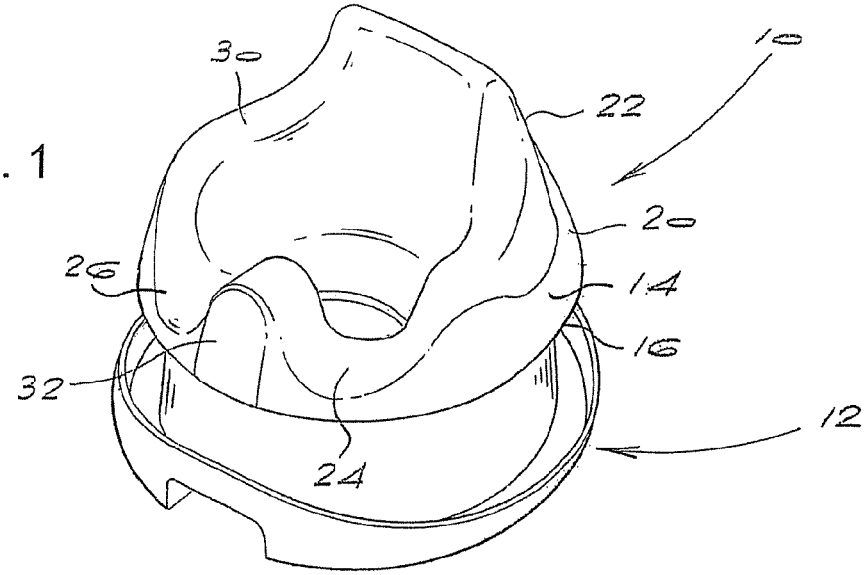
FIG. 1 is a pictorial view of a toilet training system comprising a seat and a base unit according to the present invention, assembled in a second configuration.
Figure 2:
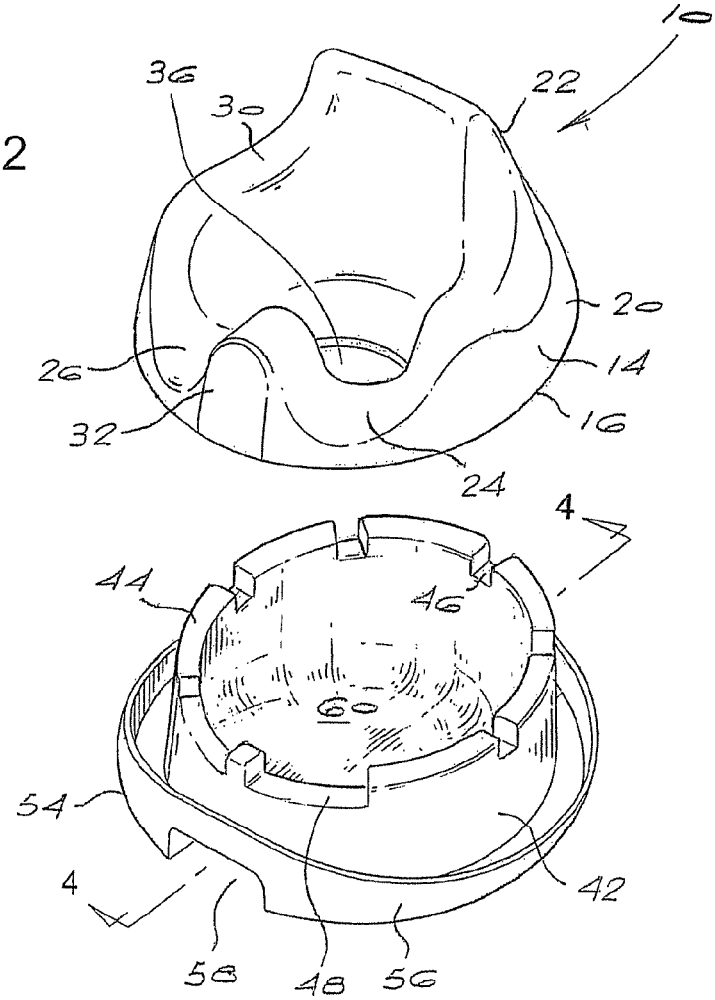
FIG. 2 is an exploded view of the system of FIG. 1.

Referring first to FIGS. 1 and 2, a seat 10 of the kind referred to above is shown with a base 12 according to the present invention.

The seat 10 is preferably moulded primarily as a single piece from a firm but soft plastics material, such as polyurethane foam or another material having suitable characteristics. The material used should be sufficiently firm and dense to maintain its shape in use but preferably be soft to the touch and deformable to an extent, should have a water resistant outer layer with an easily cleanable surface, and be as light as possible. Internal ribs or a "skeleton" may be included in the moulded seat to stiffen it where needed. Ideally the materials used would be recyclable or biodegradable.

The seat 10 has a peripheral rim 14 which defines a stepped mounting formation which is generally oval or egg-shaped in plan, corresponding to the general shape of the rim of a standard toilet bowl. The mounting formation is shaped to fit over complemental mounting formations on the base 12, in the form of a flange 16. The latter is shaped to correspond to some extent to the profile of the rim of a conventional toilet bowl, so that the seat can also be mounted firmly but removably on top of either the base or a toilet bowl. The abovementioned degree of deformability allows the seat to be fitted to toilet bowls of slightly varying shape.

An upstanding side wall 20 extends upwardly from the peripheral rim 14. At a first, rear end of the seat, the side wall extends upwardly to define a backrest 22. As best seen in the sectional views of FIGS. 5 and 6, the inner surface of the backrest has a tapered profile which is inclined forwardly from the vertical at an angle which is typically from 5 to 15 degrees, preferably about 10 degrees.

The upstanding side wall 20 extends forwardly from the back rest towards a second, front end of the seat, where two openings 24 and 26 are formed in the side wall to allow the legs of a child seated in the device to protrude. Where the side wall 20 extends forwardly from either side of the backrest 22, its upper edge 30 is lower than the top of the backrest 22 and the height thereof is chosen to assist in keeping an infant in the seat. Between the openings 24 and 26 is a small section 32 of the upstanding side wall which lends itself to be used as a grip or "pommel" (similarly to the pommel of a saddle). In the prototype device, the upper edge 30 of the side wall 20 was approximately 12 cm above the lower edge of the rim 14, while the upper end of the grip or "pommel" 32 was approximately 10 cm above the lower edge of the rim.

The openings 24 and 26 define generally flat, slightly convexly curved leg support surfaces which are inclined relative to the horizontal at an angle of between 5 and 15 degrees, preferably about 10 degrees. Thus, the included angle between the support surfaces and the inner surface of the backrest 22 is an acute angle between 60 and 80 degrees, most preferably about 70 degrees.

The central portion of the seat 10 comprises a curved seat member 34 which is shaped to receive the buttocks of a child, with the child's back in contact with the inner surface of the backrest 22 and the child's legs extending through the openings 24 and 26. An opening or aperture 36 in the seat member is sized and located to allow a child to urinate and defecate freely there through into a toilet bowl or a receptacle defined by the base 12, as described below. As can be seen most clearly from FIGS. 5 and 6, the lowermost portion of the seat member 34 extends approximately 8 cm below the peripheral rim 14 of the seat. This ensures that the seat has a low centre of gravity in use.

In the prototype device, the internal distance from front to back of the seat, between the inner surface of the backrest 22 and the inner surface of the "pommel" 32 was approximately 19 cm, while the internal distance between the upstanding side walls from side to side was approximately 20 cm. The overall height of the seat itself was approximately 21 cm, and about 35 cm when used together with the base, measured from the top of the backrest.

The opening 36 is generally teardrop shaped, with an enlarged first end portion 38 which is located approximately centrally in the seat member, and a tapered second end portion 40 which extends forwardly, away from the backrest 22 towards the upstanding wall portion 32, as shown. The tapered end portion 40 extends up the curved surface of the seat member 34 and its extreme end is higher than the enlarged first end portion 38. In the prototype device, the overall length and width of the aperture were approximately 20 cm and 9 cm, respectively, and the distance between the tapered end portion 40 of the aperture and the top of the "pommel" 32 was approximately 2.5 cm.

In one embodiment of the seat, a polypropylene reinforcing member is moulded into the seat member 34 about the aperture 36. The reinforcing member increases the strength of the seat member and increases the resistance of the foam material of the seat to tearing.

The size and the somewhat elongated shape of the teardrop shaped aperture, which is fitted and curved anatomically, are designed to accommodate children of varying ages from about 4 months to 3 years of age, and to allow unimpeded discharge of urine and faeces from both male and female children while being no larger than necessary. The design of the fitted and curved aperture addresses the issue of horizontal urination by males, with the upwardly extending tapered end portion 40 accommodating a male child's penis without obstruction.

Figure 7:
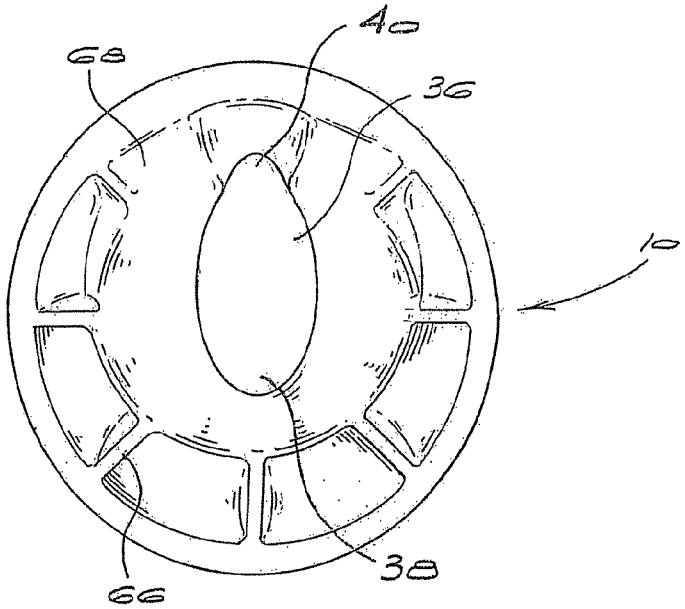
FIG. 7 is an under plan view of the seat, showing strengthening ribs thereof.

The base 12 is moulded from a stiff plastics material such as food grade polypropylene and has a generally cylindrical shape, with an upstanding outer side wall 42 which is circular or near-circular in plan. At a first end of the base, a first end surface 44 is defined which in plan is generally annular and in which a number of cut-outs are formed to define a notched or crenelated structure. Five narrow cut-outs 46 are formed on one side of the end surface 44, with a pair of broader cut-outs 48 on an opposed side of the end surface 44. The cut-outs correspond to the shape of ribs 66 and 68 formed on the underside of the seat 10 (see FIG. 7), allowing the seat to be mounted securely on the first end of the base.

At the opposite end of the base from the first end, a second end surface 54 is shaped similarly to the shape of a conventional toilet bowl rim, with a peripheral lip 56 extending around the end surface 54. A recess 58 defining a hand-hold is formed at one side of the end surface 54, in the lip 56.

The shape of the second end surface is chosen partly for ease of manufacture of the base, and also to correspond somewhat to the shape of a conventional toilet bowl rim, ensuring positive seating of the seat 10 on the base on this end surface. This corresponds to an orientation of the base which is likely to be used with larger and heavier infants.

Extending transversely relative to the outer side wall 42 is a generally cup-shaped partition member which has an inclined, curved central portion 50 which extends generally transversely to the side wall 42, and an upstanding cylindrical inner side wall 52 disposed within the outer side wall 42 and extending substantially parallel or at a shallow angle relative to the side wall 42. The "rim" of the cup shaped partition member defined by the inner side wall 52 is connected to the first end of the base, at an inner edge of the first end surface 44 of the base.

Depending on the orientation of the base, the inner side wall 52 and the curved central portion 50 of the partition member can be thought of as defining a cup-shaped receptacle 60 within the outer side wall 42, or alternatively as defining an upstanding pedestal within the outer side wall 42.

Figure 3:
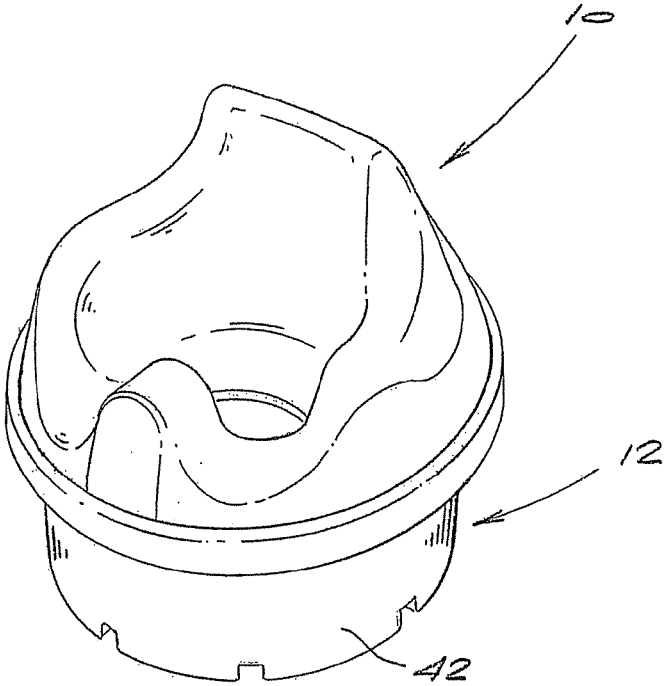
FIG. 3 is a pictorial view of the toilet training system with the seat and the base unit assembled in a first configuration.
Figure 4:
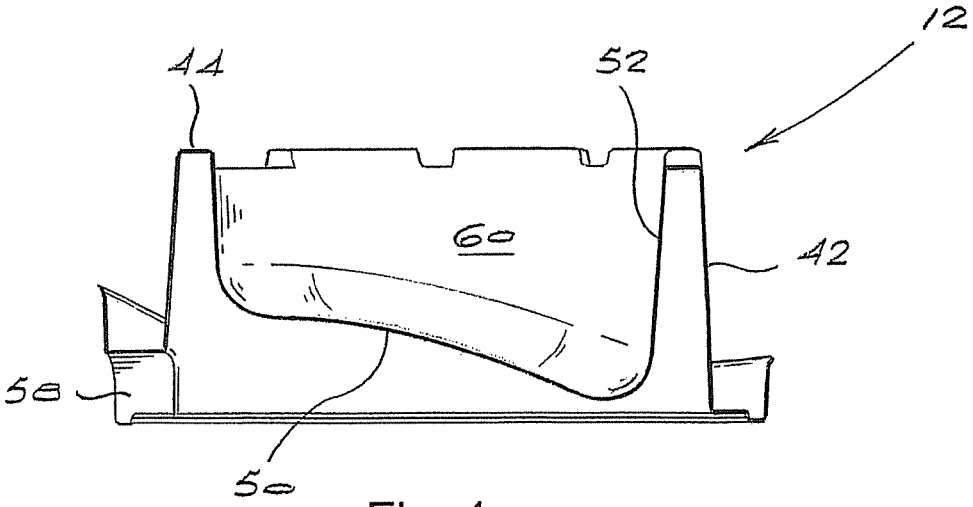
FIG. 4 is a sectional view of the base unit on the line 4-4 in FIG. 2.
Figure 6:
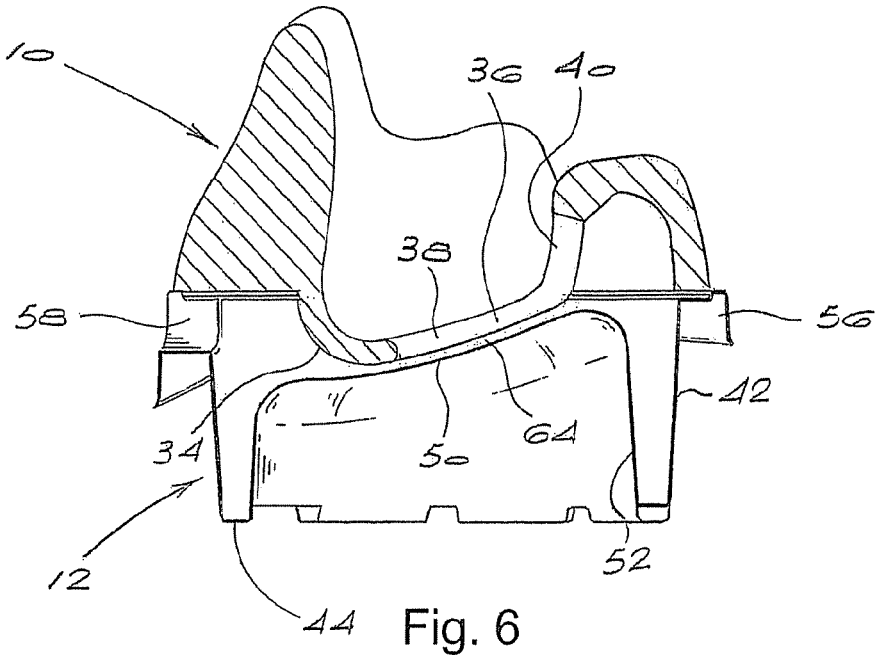

The shape, inclination and curvature of the central portion 50 of the partition member are determined by the curvature of the underside of the seat member 34, particularly in the configuration shown in FIGS. 3 and 6. As can best be seen in FIG. 6, when the seat 10 is mounted correctly on the base 12, the underside of the seat member 34 and the upper surface of the central partition member 50 are spaced closely together, defining a relatively narrow gap 64 of generally uniform height.

Preferably, the height of the inner side wall is selected such that when the base and seat are in the illustrated configuration, the curved central portion of the partition member is spaced closely to the curved surface of the central seat member of the seat. The spacing should be less than 5 cm, and more preferably less than 2 cm or even 1 cm. Ideally, the upper surface of the curved central portion of the partition member should just contact the underside of the curved under-surface of the seat member 34, or the gap between them should be very small, of the order of 1 mm or even less.

The effect of this is that, viewed from above, the surface of the central portion 50 of the partition member is clearly visible through the aperture 36 in the seat member. This helps to acclimatise the child initially to the use of the device.

The reason for this is that in this first, "beginner" configuration the system is not intended to be used by a child as a "potty", but rather as a means of familiarising a child with the system. Typically, therefore, an infant will be placed in the seat wearing a nappy or diaper, and the fact that the upper end of the partition member is visible through the aperture 36 in the seat member 34, with no substantial or obvious gap between the two (and preferably substantially no gap), ensures that the infant is not made uncomfortable by the sight of a deep or dark cavity below the seat. This helps to acclimatise the child initially to the use of the system. Essentially, the child sees the system as a comfortable seat in this configuration.

Figure 5:
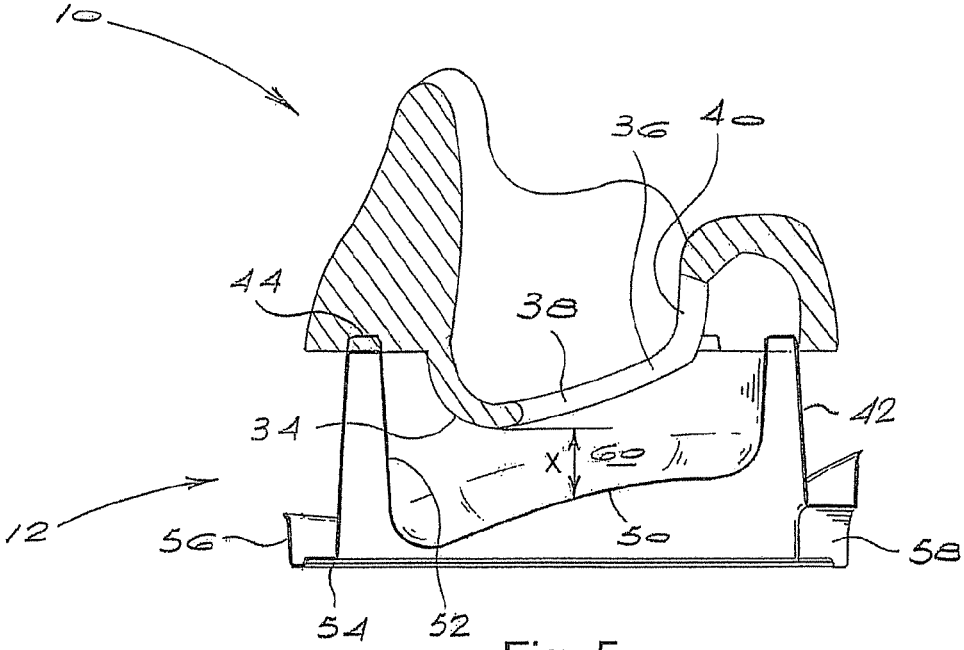
FIGS. 5&6 are sectional side views of the assembled system in the second and first configurations thereof, corresponding to FIGS. 1 and 3, respectively.

Referring now to FIGS. 2 and 5, the seat 10 is shown mounted on the upper end surface 44 of the base, with the curved seat member 34 extending into the receptacle 60 defined by the central portion 50 of the partition member. In this second, "intermediate" configuration, the surface of the central portion 50 of the partition member is somewhat further away from the underside of the seat member 34, typically a distance X in the range 2 cm to 10 cm, preferably 4 cm to 7 cm, and most preferably about 5.5 cm away.

This distance X is preferably measured vertically from the centre of the curved central portion 50 of the partition member to the height of a lowermost inner edge of the aperture in the seat member, as indicated in FIG. 5. Towards the front and rear of the aperture 36 the distance between the partition member and the seat member increases slightly, to about 7 to 9 cm, due to the relative curvatures of the seat member and the partition member.

In this configuration, the gap between the partition member and the seat member is sufficient to allow a child to use the system as a "potty", but the partition member is still clearly visible below the aperture 36. This is therefore less likely to make a child uncomfortable than the existence of a deeper, darker space beneath the seat member. The volume of the receptacle 60 is ample for this purpose.

It is possible to manufacture the base with a partition member having a central portion 50 which is substantially planar, and which is merely inclined to match the inclination and curvature of the seat member 34. Such a base would retain most of the advantages of the version of the base described above.

Once the child is used to the presence of an opening under the seat member, a third, "advanced" configuration of the system can be used, wherein the seat is mounted directly on the rim of a toilet bowl without the use of the base. In this configuration, the seat is placed securely on the rim of the toilet bowl by an adult assisting the child and holds the child securely in position, with the overall centre of gravity of the seat and the child together being maintained relatively low due to the fact that the lowermost part of the seat member extends below the rim of the seat.

Once the child is large enough, he/she can graduate easily to use of the toilet without the training system.

Figure 8:
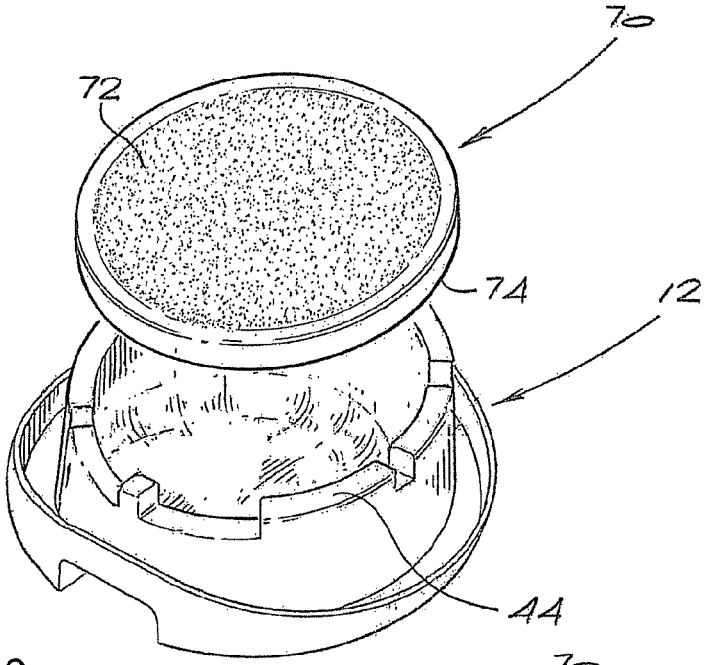
FIG. 8 is an exploded pictorial view showing the base unit and an associated lid or cover.
Figure 9:
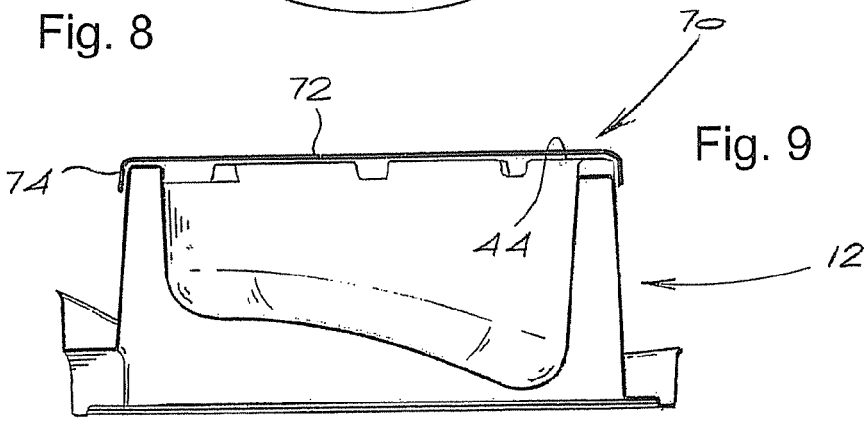
FIG. 9 is a sectional side view of the base unit showing the cover in place on top of the base unit.

To enhance the usefulness and versatility of the described system, a lid or cover 70 can be provided for the base 12, as shown in FIGS. 8 and 9. The cover serves as a lid to cover the receptacle defined by the base, so that the base can serve as a container, but also serves to convert the base into a step. The illustrated cover has a flat central area 72 with a peripheral lip 74, and is sized to fit over the upper end surface 44 of the base as shown. The central area 72 is roughened or textured to provide a secure, non-slip footing for a child using the cover and base as a step. The cover 70 can be moulded from the same material as the base or can be formed from another suitable material.

When used as a step, the base and cover can be used independently of the seat, for example to enable a child to reach a sink or to enable a larger child to stand and urinate into a toilet bowl. The base and cover can also be used with the seat, in particular to enable a larger child to reach the seat when the seat is mounted on a toilet bowl. This extends the useful life of the system.

The seat and base (with or without the described cover) can be sold together as a kit or system, or the components can be provided separately.

Apart from other advantages, the seat, and aperture, is shaped to the baby's bottom and supports baby on both sides and front and back keeping them feeling safe and secure. This is an important difference between the present invention and conventional toilet trainers, for example, those that simply make the aperture smaller.

The invention claimed is:

1. A toilet training system comprising a seat and a complemental base, wherein the seat has a central seat member with a curved surface defining a cavity shaped to accommodate a child, the seat member having an aperture therein, the base comprising a cylindrical outer side wall and a partition member extending transversely relative to the side wall to define at least a first receptacle, the partition member having a central portion with a surface which is inclined or curved complementally to the curved surface of the seat member, wherein the surface of the partition member from the central portion to a rear portion is inclined or curved in a downward angle away from the seat member.

2. The toilet training system of claim 1 wherein the seat is mountable on the base in first and second configurations of the system, the central portion of the partition member being located relatively closely to the seat member in the first configuration, and being spaced relatively further apart from the seat member in the second configuration.

3. The toilet training system of claim 2 wherein, in the first configuration, the central portion of the partition member is spaced less than 5 cm from the underside of the seat member.

4. The toilet training system of claim 3 wherein, in the first configuration, the central portion of the partition member abuts the underside of the seat member.

5. A base for use with a seat of a toilet training system, wherein the seat has a central seat member with a curved surface defining a cavity shaped to accommodate a child, the seat member having an aperture therein, the base comprising a cylindrical outer side wall and a partition member extending transversely relative to the side wall to define at least a first receptacle, the partition member having a central portion with a surface which is inclined or curved complementally to the curved surface of the seat member and wherein the surface of the partition member from the central portion to a rear portion is inclined or curved in a downward angle away from the seat member.

6. The base of claim 5 wherein the partition member is cup shaped, with a central portion which extends generally transversely to the outer side wall, and an upstanding inner side wall disposed within the outer side wall and extending substantially parallel or at a shallow angle relative to the outer side wall.

7. The base of claim 6 wherein the inner side wall is cylindrical, and defines a receptacle having a circular or oval shape in section within the inner side wall.

8. The base of claim 6 wherein the central portion of the partition member is curved, with a curvature complemental to a curvature of the curved surface of the central seat member of the seat.

9. The base of claim 8 wherein the height of the inner side wall is selected such that when the base is in a first orientation thereof relative to the seat, the curved central portion of the partition member is spaced a first predetermined distance from the curved surface of the central seat member of the seat.

10. The base of claim 9 wherein the first predetermined distance is in the range 0 to 5 cm.

11. The base of claim 10 wherein the first predetermined distance is less than 1 cm.

12. The base of claim 11 wherein, when the base is in the first orientation thereof, the curved central portion of the partition member abuts or nearly abuts the curved undersurface of the central seat member of the seat.

13. The base of claim 8 wherein, when the base is in a second orientation thereof relative to the seat, the curved central portion of the partition member is spaced a second predetermined distance from the curved surface of the central seat member of the seat.

14. The base of claim 13 wherein the second predetermined distance is in the range 2 cm to 10 cm.

15. The base of claim 5 including a cover or lid shaped to fit over an end of the base, the lid having a flat central surface and a peripheral formation for retaining the lid on the base.

* * * * *